United States Patent [19]

Grochowski et al.

[11] Patent Number: 4,752,213

[45] Date of Patent: Jun. 21, 1988

[54] FORCED-AIR GAS BURNER

[75] Inventors: Guy Grochowski, Deuil la Barre; Alain Meslif, Luzarches, both of France

[73] Assignee: Gaz de France, Paris, France

[21] Appl. No.: 927,024

[22] Filed: Nov. 5, 1986

[30] Foreign Application Priority Data

Nov. 6, 1985 [FR] France ..... 85 16439

[51] Int. Cl.[4] ..... F23D 14/02; F23D 14/12

[52] U.S. Cl. ..... 431/328; 431/351

[58] Field of Search ..... 431/7, 170, 210, 326, 431/328, 351; 126/92 AC, 92 C

[56] References Cited

U.S. PATENT DOCUMENTS

| | | | |
|---|---|---|---|
| 2,718,919 | 9/1955 | Ray | 431/210 |
| 2,956,622 | 10/1960 | Druseikis | 431/210 |
| 3,237,679 | 3/1966 | Best | 431/210 |
| 3,527,199 | 9/1970 | Perry | 431/328 X |
| 4,082,497 | 4/1978 | Crawford et al. | 431/351 X |
| 4,224,019 | 9/1980 | Dilmore | 431/328 |
| 4,311,447 | 1/1982 | Rackley et al. | 431/328 X |
| 4,492,564 | 1/1985 | Wolf | 431/328 |
| 4,499,890 | 2/1985 | Meulenbrug | 431/328 X |
| 4,610,626 | 9/1986 | Kikutani et al. | 431/351 |
| 4,668,012 | 8/1986 | Cooper | 431/328 |

FOREIGN PATENT DOCUMENTS

| | | | |
|---|---|---|---|
| 535753 | 2/1955 | Belgium . | |
| 0062797 | 10/1982 | European Pat. Off. | 431/328 |
| 130742 | 1/1985 | European Pat. Off. . | |
| 1002712 | 2/1957 | Fed. Rep. of Germany . | |
| 1710496 | 12/1971 | Fed. Rep. of Germany . | |
| 1307069 | 9/1962 | France . | |
| 723437 | 2/1955 | United Kingdom . | |
| 1556383 | 11/1979 | United Kingdom . | |

*Primary Examiner*—Margaret A. Focarino

*Attorney, Agent, or Firm*—Pollock, Vande Sande & Priddy

[57] ABSTRACT

A gas burner having a forced air intake and a combustible gas intake. A source of primary air also feeds secondary air to the combustion products at approximately the level of the surface of a plate through which combustion products escape.

13 Claims, 4 Drawing Sheets

FORCED-AIR GAS BURNER

FIELD OF THE INVENTION

The invention concerns a gas burner of a type comprising a forced air intake and a combustible gas intake feeding a premixing chamber which opens onto at least one ceramic plate at which level the combustion occurs.

BACKGROUND OF THE INVENTION

Much research has been effected on this type of burner.

First of all, there are ceramic plate burners used notably to heat large, open volumes such as hangars or halls of large dimensions. These burners generally function with free air and are not destined to be used in pressurized areas. Also, there are ceramic plate burners which are able to be used in combustion chambers of industrial gas burners. In this case, the air admitted into the burner is totally used for combustion and mixed, for that purpose, with a combustible gas which involves certain disadvantages. In particular, the pressure increase which appears after ignition has a tendency to provoke the reduction of the flow of air and to make the flame oscillate on the plate which translates into a well-known instability which provokes perturbations of the burner function. Furthermore, this phenomenon involves the appearance of noises after ignition which develop in the pressurized combustion chamber and often continue permanently.

There is also another category of burners using forced air and premixing with an air bypass consisting of a hanging grill of flames. This technique allows for a relatively silent and stable combustion. However, this type of burner is relatively bulky and is not adapted for use in small combustion chambers in cooperation with high load loss exchangers. In effect, if the ceramic plate resists a high temperature and allows combustion with a very suppressed flame, such a function is not expected in a grilled burner without involving on one hand the deterioration of the grilles, and, on the other hand the returning of the flame into the burner.

SUMMARY OF THE INVENTION

According to the invention, the air intake, apart from the aforementioned feed of primary combustion air to the premixing chamber, feeds at least one secondary air circuit found parallel to said air intake circuit and opening onto the level of the surface of said plate through which escape the combustion products. In this way the change in pressure engendered at ignition of the burner at the level of the surface of said plate through which escape the combustion products is transmitted via the intermediary secondary air circuit to the premixing chamber. This phenomenon of pressure equilibrium on both sides of the plate softens the oscillations of the flame and suppresses any ignition noises, notably due to the on/off action of the fan which feeds the burner with air. This flame stability offers the possibility of maintaining, permanently, whatever the feed conditions, a very suppressed flame on the plate, and, thus the conception of more compact exchangers which receive an important proportion of their power from radiation, thus minimizing the exchange surface through convection. Moreover, since a portion of the forced air admission flow of the burner is derived from the secondary air circuit, the gas mixture is richer in combustible gas, involving a better flame attachment and allowing an elevated load rate (power per $cm^2$ of plate), and thus an increased flexibility.

According to another characteristic of the invention, the said secondary air circuit is in contact at least partially with one wall of said premixing chamber while being channeled into a chamber between its entrance in this chamber and its exit at the level of said plate. This conception permits a simple yet compact fabrication.

Moreover, according to an advantageous conception of the invention, the burner is composed of several ceramic plates formed in a stack between which are installed intermediary spaces in communication with said premixing chamber and across which run the gas mixture where the topmost plate of the stack forms a seal for the premixing chamber. Thus is obtained a flame with a reduced diameter allowing for a reduction of the diameter of the combustion chamber and an improved compactness, notably that concerning the conception of the exchangers.

BRIEF DESCRIPTION OF THE FIGURES

The invention and its putting into action will appear more clearly with the aid of the following description made in reference to the appended figures in which.

DETAILED DESCRIPTION OF THE INVENTION

First of all, in reference to any one of the figures, the entire burner [1] is fed forced air and combustible gas through two separate conduits [5] and [6], respectively.

More specifically, the burner [1] consists of a premixing chamber [3] fed by forced air at air inlet conduit (5) and combustible gas at gas intake conduit (6) and opens onto at least one ceramic plate (4). The forced air inlet conduit (5), in addition to feeding primary air to the premixing chamber [3] through connecting openings [15], feeds at least one tubular secondary air circuit in a chamber [2] which opens up at the level of the outer surface [41] of the ceramic plate [4] through which escape the combustion products. The chamber [2], in which secondary air circulates, extends appreciably the entire height of the premixing chamber [3]. In other words, the secondary air circuit is in contact, or bathes, one wall [30] of the premixing chamber [3] and is channeled into the chamber [2] between its admission through openings [21] and its evacuation through holes [22] at the level of the plate [4].

Figure 1:
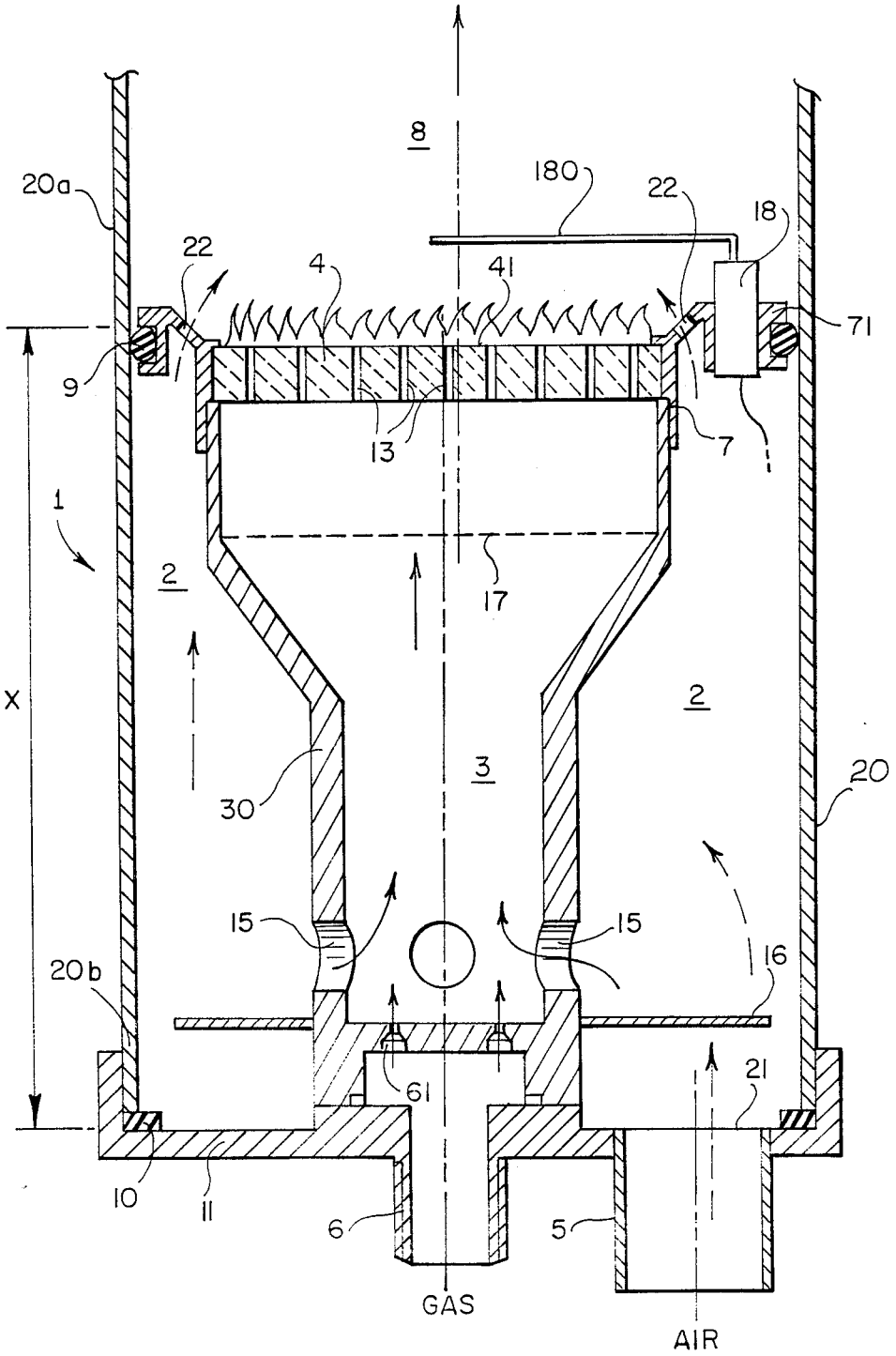
FIG. 1 shows a cross-section schematic view of a burner corresponding to the invention.

Advantageously, the connecting openings [15] between the chamber [2] and the premixing chamber [3] are installed toward the base of the chamber [3] in the wall [30] of this chamber. These openings can, for example, number four and be evenly distributed along the periphery of the wall [30]. Moreover, the feding of the premixing chamber [3] with combustible gas can be effected, for example, across calibrated holes [61] which are in gas flow communication with the gas intake conduit [6]. It is noteworthy that in order to obtain the desired combustible gas/primary combustion air dosage, the diameter and the number of openings [61] and [15], respectively, are to be determined. Now, referring more specifically to FIG. 1, it is noted that the chamber [2] surrounds the premixing chamber [3] like a ring. More specifically, the wall [30] limiting the premixing chamber [3] forms a cylindrical tube which widens in the direction of the flow of mixture, which is to say toward the ceramic plate [4] onto which said chamber [3] opens. It is noteworthy that under these conditions the wall [30] forms a common wall with the premixing chamber [3] and the chamber [2]; this latter being limited, moreover, by an exterior enclosure [20] forming a cylindrical wall which, as shown in FIG. 1, extends lengthwise to the premixing chamber [3] toward the summit of this chamber. This plate [4], in which the combustible gas mixture evacuation openings [13] are formed, is held solidly to the wall [30] by means of a clamp [7] fixed to said wall [30] and extending, moreover, transversally to the preheating chamber [3] and forming a flange [71]. The means of attaching the clamp [7] to the wall [30] can, for example, consist of a rivet, a screw, or an adhesive. Care should be taken, according to the method of attachment, that a metallic material such as steel or aluminum is selected, or that an adhesive resistant to high temperatures is used.

Calibrated holes [22] are provided in the flange [71] forming exit openings for secondary air which comes from the chamber [2] and opens into the combustion chamber [8]. Moreover, the flange [71] comes into contact with the inner surface of exterior enclosure [20] of the chamber [2].

It is to be noted that in the usage considered in FIG. 1, the essential elements making up the burner [1] are arranged in the combustion chamber [8] whose exterior enclosure [20*a*] is common to that wall [20] of the chamber [2].

The base of the burner is sealed with a collar [11] which is adapted to the extremities of the enclosure [20] and of the wall [30] through which combustible gas and air are admitted. Burner feed conduits [5] and [6] are installed in this collar. It is anticipated that the collar [11] lightly covers up the base of the exterior wall of the burner, that is to say in this case the enclosure [20], on its outside face of base [20*b*].

Moreover, gaskets [9] and [10] assure the burner's airtightness.

Gasket [9] advantageously makes airtight contact between the flange [71] and the exterior enclosure [20]. One can notably foresee a ceramic gasket sheathed in glass fibers or any other gasket resistant to high temperatures.

Gasket [10], placed at the base [20*b*] of the enclosure [20] has its junction with the collar [11] and isolates the chamber [2] while avoiding any escape of air toward the exterior of the burner. This gasket can, for example, be made of rubber or of "Teflon" (trademark).

It is to be noted that the premixing chamber [3] can run a distance of x along the enclosure [20] so that the plate [4] is placed at the level of the base [20*b*] of the enclosure [20]; the contact point for the gasket [9] being adapted to allow this movement. In this case, it is advantageous to foresee a "box of air" (not represented) placed in a way so as to act as the chamber [2] and to channel secondary air around the premixing chamber [3] toward the flange [71].

Figure 2:
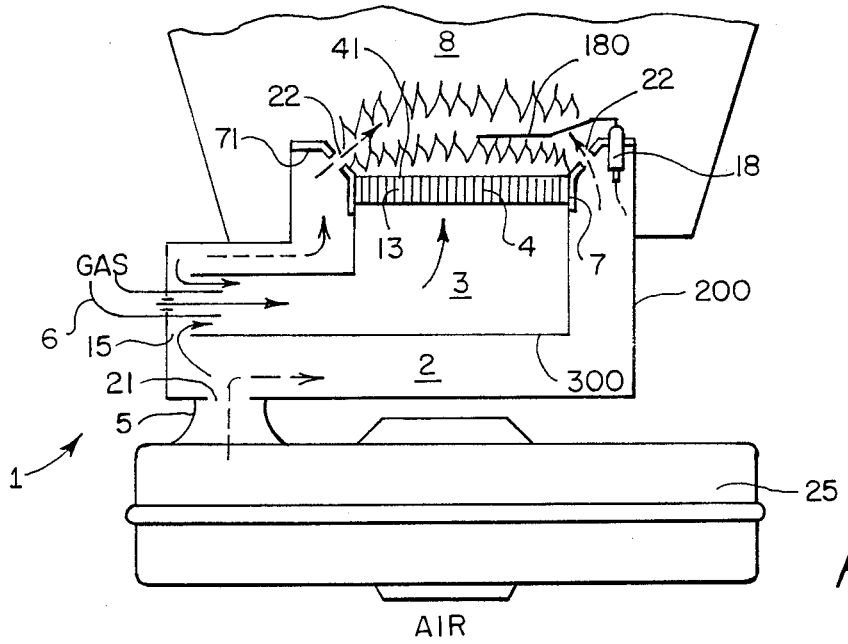
FIG. 2 presents a schematic view of a possible variation of the burner in the invention.

Now referring to FIG. 2, which is a variation of the burner presented in FIG. 1, the essential elements are organized and installed perceptibly in an identical fashion as that described above.

It can be seen, however, that the walls of the premixing chamber [3] and of the chamber [2] are presented in the form of elbowed sleeves [200] and [300], respectively, in rectangular or square sections.

Figure 3:
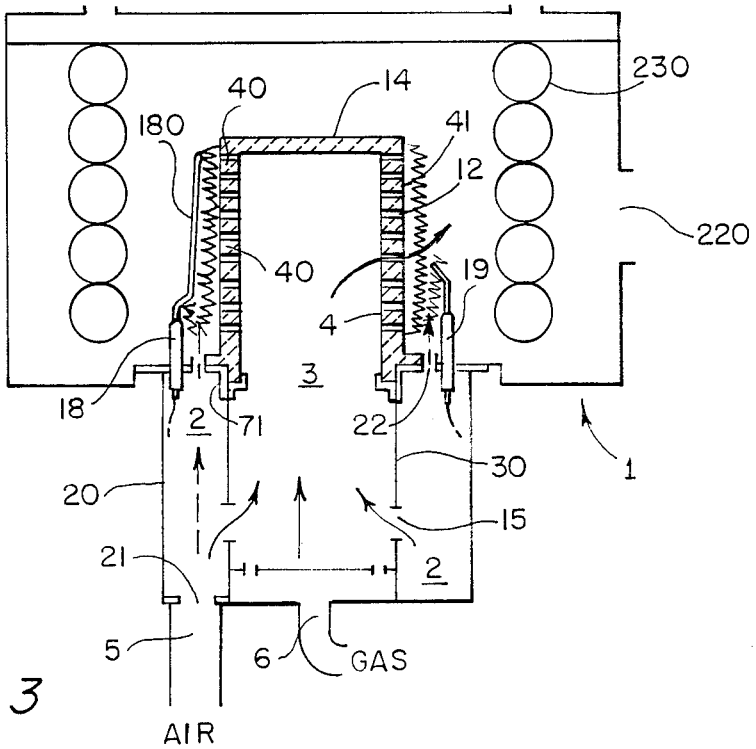
FIG. 3 shows a schematic representation of the burner of the invention including several ceramic plates formed in a stack.
Figure 4:
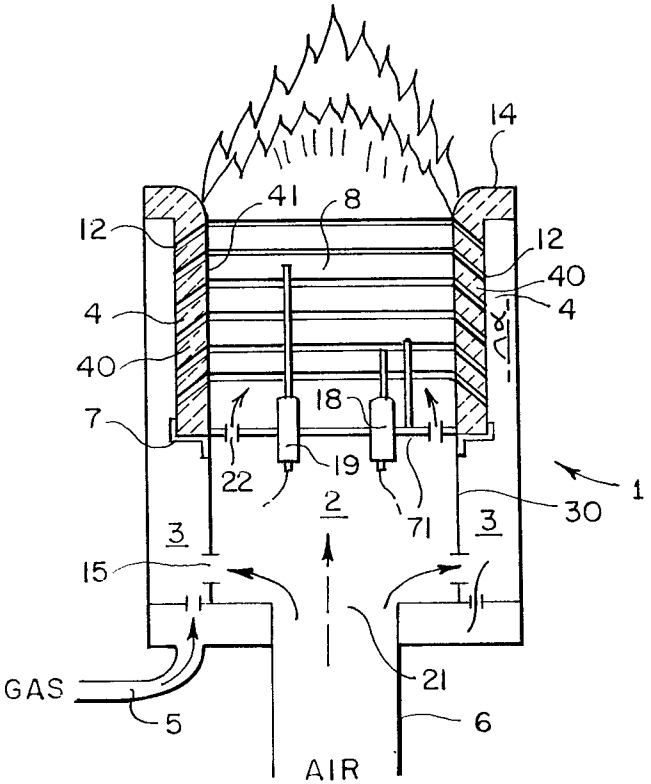
FIG. 4 presents a schematic representation of a variation of the burner shown in FIG. 3.

In referring to FIGS. 3 and 4, it can be seen that the burner [1] can be made up of several ceramic plates [4] in a stack between which are provided intermediary spaces [12] connecting with the premixing chamber [3] and across which runs the gaseous mixture issuing from this chamber. It can be noted that the plate (14) at the top of the stack forms a sealing plate to the premixing chamber [3]. Moreover, secondary air circulating in the chamber [2] opens toward the base of the stack at the side of the exterior surface [41] of said plates.

Advantageously, each ceramic plate [4] forming the stack is made up of a disk [40] of which at least one of the faces is channeled or crenelated. In this manner the free space left by the different calibrated crenels makes up the aforementioned intermediary spaces and permits the flow of the gaseous mixture.

The cohesion of the different plates can be assured, notably, by a partial nesting of one within another while forming, for example, a tenon/mortise association.

The stack thusly formed is perceptibly placed advantageously parallel to the flow of gas which circulated from feed conduits [5], [6] toward the plates [4], [14].

Referring more specifically to FIG. 3, it can be seen that the stack of plates [4] extends the premixing chamber [3], the exit openings [22] of secondary air being provided at the summit of the chamber [2] and opening toward the base of the stack. The openings [22] can be provided on the flange [71], such as previously described, which assures, notably, the maintenance of the base plate of the stack.

In the mode embodied in this figure, the chamber [2] encircles the premixing chamber [3] which extends to the top plate (14) of the stack.

In referring to FIG. 4, the premixing chamber [3] encircles the chamber [2] and the stack of plates [4], and the top disk [14] shows a diameter larger than the other disks of the stack and serves to seal the summit of the premixing chamber, as previously described.

It is noteworthy that a flange [71] can be provided which extends transversally across the top of the chamber [2] and in which are installed the exit openings [22] of secondary air. The flange can form a fixing clamp with the base of the stack.

The burner of the invention as presented in a certain number of non-limiting variations functions as follows.

Forced air issued from the feed conduit [5], linked to a fan [25], for example (FIG. 2), flows into the base of chamber [2] where it is split between a primary air flow admitted into the premixing chamber [3] by openings [15] and a secondary air flow which is channeled into the chamber [2] by openings [22] through which it is injected at the level of the plate [4] toward its exerior surface [41] without being mixed with the combustible gas.

Furthermore, the primary air flow is mixed with the combustible gas coming from conduit [6] and flows into the premixing chamber [3] toward the ceramic plate (FIGS. 1 and 2) or toward the stack of plates (FIGS. 3 and 4) where it is ignited.

So as to make the description clearer on the different figures, the flow of primary air and combustible gas is marked as a solid arrow, and secondary air as a dashed arrow.

In order to assure adequate distribution of the air flow once it has entered the burner, a deflector plate [16] can be placed transversally to the base of the chamber [2].

Moreover, in order to homogenize the gas/primary air combustion mixture, a grille [17] can be used which extends transversally to the flow of the gaseous mixture in the premixing chamber [3].

Ignition of the burner and the control of its flame can be accomplished, such as by the use of ignition and ionization electrodes [18], [19], respectively, which can be fixed to the previously described flange [71] and can be fed with electricity (not represented).

Advantageously, the ignition electrode [18] in the combustion chamber [8] (see FIG. 6) extends near the surface [41] of the plate(s) through which escape the combustion products.

The combustion flames thus develop in the openings [13] or the intermediary spaces [12] in the direction of the combustion chamber [8].

The calibrated openings [15] and [61] permit the formation of a mixture rich in combustible gas in the premixing chamber [3] which leads to a flame that can be maintained in the plate(s) and which arises notably in the openings [13] (FIGS. 1 and 2) or intermediary spaces [12] (FIGS. 3 and 4).

Secondary air injected at the level of the exit surface [41] of the plate (4) terminates the combustion of the gaseous mixture. In this way the flexibility of the burner vis-a-vis, pressure limits and gas, can be increased, no matter to which family they belong. In effect, this particular conception allows the blowing zone of the flame to be shifted while increasing the withdrawal of the flame in the ceramic plate without deteriorating the combustion conditions with only a nominal adjustment. Moreover, this configuration allows the admission of all combustible gases of the second family, as well as those of the third family. It is noted that for the gases of the second family, the replacement of a Group H gas (strong calorific capability) by a Group L gas (weak calorific capability) or inversely necessitates no intervention in the burner with their feed pressure, respectively.

The burner of the invention, notably that presented in FIG. 1, or possibly that of FIG. 2, is adapted for the assurance, for example, of the heating up of the enclosure of a furnace or a tube cluster or ribbed tube exchanger. In this case the combustion products issuing from the plate [4] open directly into said enclosure, or on the heating body, the enclosure [20] of the chamber [2] terminating at the level of the plate [4] while forming a box of air to the burner.

Figure 5:
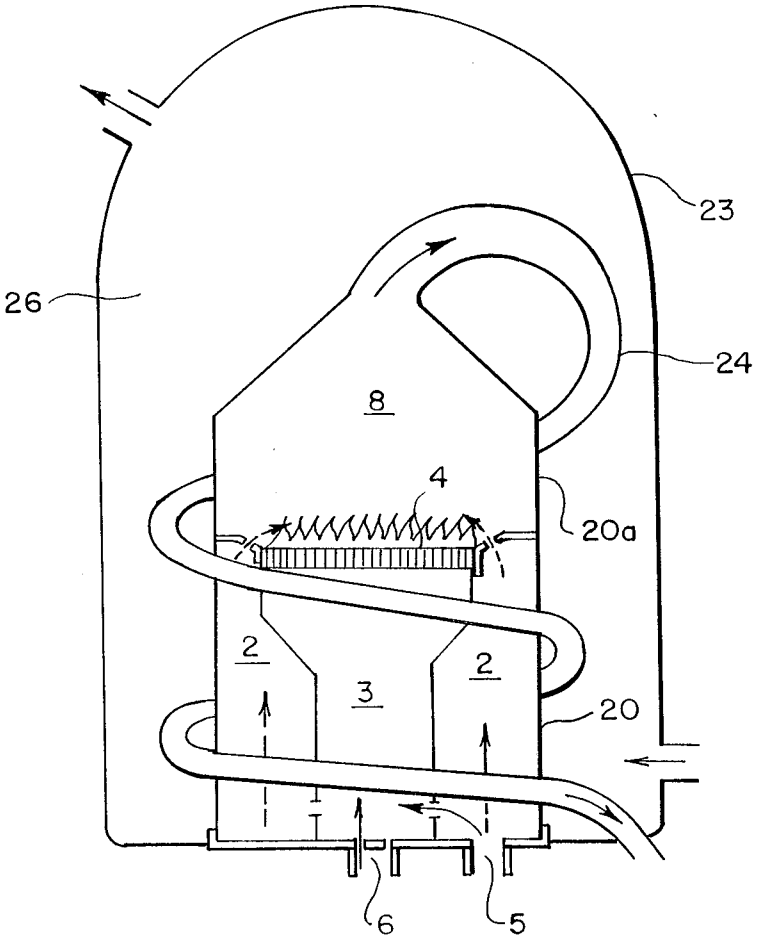
FIG. 5 shows the burner of FIG. 1 in a possible use: inside the housing forming a sanitary hot water accumulator.

Moreover, this burner configuration allows for its use as a fluid heater [26], for example, of water contained in a chamber [23] (FIG. 5). Thus it is advantageous to make use of a burner such as that presented in FIG. 1 in which the high-temperature gases issue from the combustion chamber [8] in a serpentine channel [24]. This thus limits the heating of the base of the chamber and, thanks to the serpentine channel which acts as a thermal exchanger while circulating in contact with the fluid, the condensation heat can be recovered while maintaining a very interesting compactness.

It can be cited as an example that a burner such as that presented in FIG. 1 delivers a nominal power of the order of 12 kW while offering a range of power regulation going from 6 to about 15 kW and a raised flexibility of function. The plate which can be singular can under these conditions have a surface area of 50–60 $cm^2$ and therefore a diameter on the order of 80 to 90 mm which allow a force by surface unit equal at least to about 0.2 $kW/cm^2$.

If one refers to the function of the burner in FIG. 3, it can be noted that the stack forms a "projection" in the burner and that under these conditions the combustion products escape directly toward the exterior of this burner. This configuration is notably destined to be adapted for cylindrical exchangers of a small height in which a cooling liquid such as water can circulate in the interior of the conduits [230]; the fumes issuing from the combustion escape through the opening [220].

Referring on the other hand to FIG. 4, with the premixing chamber [3] encircling the major portion of the ceramic plate stack, the combustion products escape first of all toward a combustion chamber [8] which extends at least in part to the interior of the enclosure of the burner. In this variation, secondary air issuing from the chamber [2] is injected at the base of the stack in the combustion chamber toward the center of the burner. This variation in configuration is more particularly useful to those cylindrical combustion chambers with a reduced diameter, for example. Under these conditions, ignition and the control of the presence of flames is effected in the interior of the burner.

It is noted that the orientation of the intermediary spaces [12] installed between the plates [4] forming the stacks can be such that said intermediary spaces are formed perpendicular (FIG. 3) to the gaseous flow (air, combustible gas) circulating in chambers [2] and [3] as indicated by arrows, or to be inclined toward the exterior of the burner (FIG. 4) while forming an acute angle a in relationship to the general direction of the gaseous flow.

Figure 6:
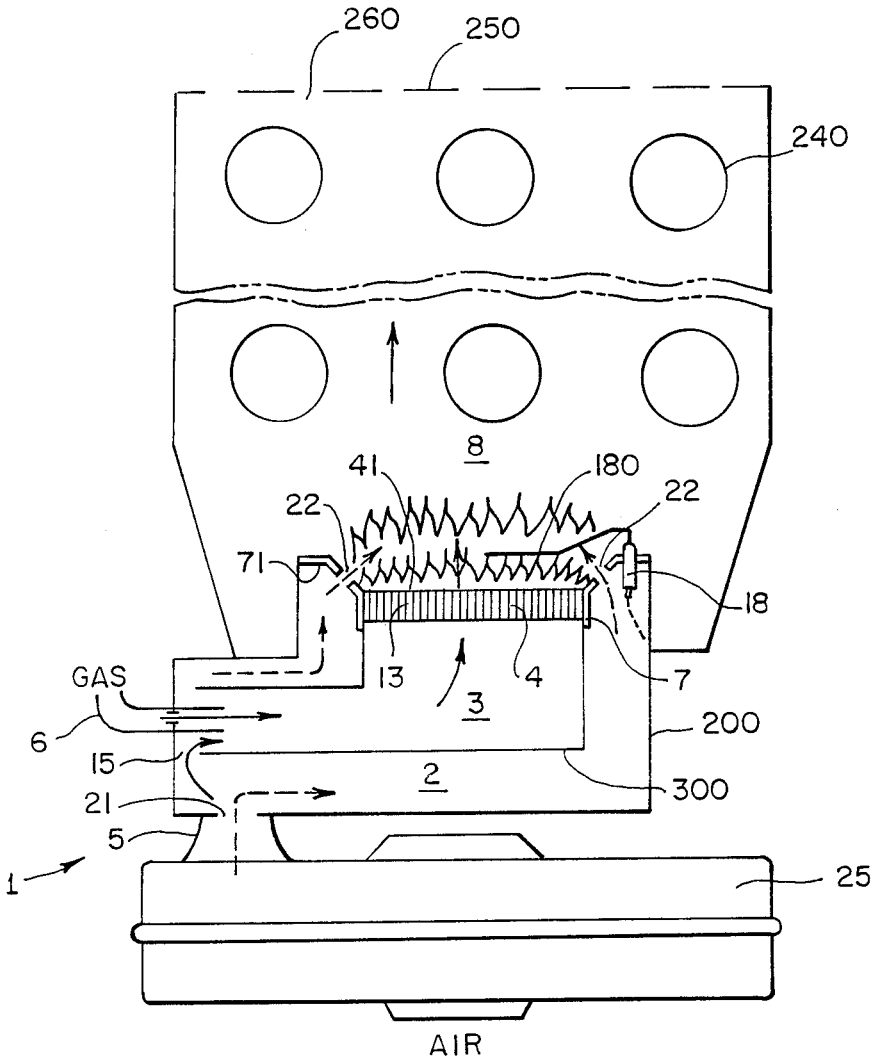
FIG. 6 shows a possible use of the burner presented in FIG. 2.

FIG. 6 is an application of the burner presented in FIG. 2. In this case the gases burned in the combustion chamber [8] are evacuated by openings [260] installed in a grill [250] while being cooled via thermal exchange through contact with tubes [240] in which a cooling fluid such as water circulates.

All the characteristics of the burner of the invention work together to procure appreciable advantages to this burner.

Notably, it can be appreciated that, thanks to the presence of secondary air, the pressure changes engendered by the ignition of the burner in the combustion chamber [8], and therefore in the proximity of the evacuation surface [41], are transmitted via the openings [22] to the chamber [2] and then, via the intermediary of the connecting openings [15], to the premixing chamber [3]. This phenomenon of pressure equilibrium on both sides of the plate reduces the oscillations of the flame after ignition while suppressing on/off noises coming notably from the fan. Moreover, thanks to a continual ventilation of the electrodes [18] and [19] through the circulation of secondary air, the problems attributed to condensation on the exterior surfaces of the electrodes is reduced, thus favoring ignition conditions.

It is especially noted in the variations presented in FIGS. 3 and 4 that the ceramic plates offer a large emitting surface; thus, the burner dissipates an important part of its power by radiation. It is thus conceived that more compact exchangers will receive an important proportion of the power through radiation, thus minimizing the surface exchange through convection.

Moreover, this particular conception of the burner leads to an improved attachment of flames to the ceramic plate, thus allowing an increased power per $cm^2$ of plate and allowing an increased flexibility. In effect, the circulation of secondary air improves the flexibility of the burner vis-a-vis the limited pressures and powers. One can thus use the combustible gases of the second or third families with an extended range of power situated between 0.10 and 0.30 kW per $cm^2$ of plate.

We claim:

1. A gas burning system comprising:
(a) a premixing chamber for premixing pressurized air and a combustible gas, said chamber opening on at least one ceramic burner plate, said burner plate having an inner surface facing said chamber and an outer surface at which level combustion products are emitted;
(b) an air intake for pressurized air;
(c) means for supplying pressurized air to said air intake;
(d) primary combustion air circuit means providing gas flow communication between said air intake and said premixing chamber for introducing a portion of pressurized air from said air intake into said premixing chamber;
(e) means for introducing a combustible gas into said premixing chamber; and
(f) secondary air circuit means providing gas flow communication between said air intake and the outer surface of said ceramic plate(s) for introducing a portion of pressurized air from said air intake to the outer surface of said ceramic plate(s).

2. A gas burning system according to claim 1, wherein said secondary air circuit comprising, in part, a second chamber which has a common wall with said premixing chamber.

3. A gas burning system according to claim 2 wherein said second chamber surrounds said premixing chamber, and a channel for air movement between said chambers is provided.

4. A gas burning system according to claim 2 wherein said primary premixing chamber surrounds said second chamber, and a channel for air movement between said chambers is provided.

5. A gas burning system according to claim 2, wherein a clamp is affixed to the common wall of the premixing chamber and the second chamber for joining at least one burner plate to said wall and which extends across said second chamber, said flange being provided with openings for exit of secondary air and at least one ignition device.

6. A gas burning system in accordance with claim 5, wherein said flange forms an exterior enclosure.

7. A gas burning system in accordance with claim 2 wherein a wall of said second chamber extends above said burner plate(s) to form a combustion chamber.

8. A gas burning system in accordance with claim 1 wherein a plurality of ceramic burner plates are stacked and provide apertures therebetween which connect with said premixing chamber, said plurality of plates including a top plate forming a seal to said premixing chamber.

9. A gas burning system in accordance with claim 8 wherein each of said plates is a disk having grooves on at least one face.

10. A gas burning system in accordance with claim 8, wherein at least portions of the plates are nested one within the other.

11. A gas burning system in accordance with claim 8, wherein said stack extends the height of said premixing chamber, and means are provided for circulating secondary air within a chamber having an air outlet opening toward the base of said stack of plates.

12. A gas burning system in accordance with claim 8, wherein said premixing chamber surrounds said stack of plates and means are provided to circulate secondary air towards an opening at the base of said stack of plates.

13. A gas burning system in accordance with claim 1, wherein grill means for mixing the gaseous mixture, pressurized air and combustion gases is provided in the path of said gaseous mixture.

* * * * *

UNITED STATES PATENT AND TRADEMARK OFFICE

CERTIFICATE OF CORRECTION

PATENT NO. : 4,752,213

DATED : June 21, 1988

INVENTOR(S) : Guy Grochowski, et al.

It is certified that error appears in the above-identified patent and that said Letters Patent is hereby corrected as shown below:

Column 2, line 68, change "feding" to --feeding--.

Column 3, line 40, change "enclosure" to --wall-- and change "wall" to --enclosure--;

line 49, after "[20b]" insert --of enclosure [20]--.

Column 6, line 65, change "is" to --are--.

Signed and Sealed this

Thirteenth Day of December, 1988

*Attest:*

DONALD J. QUIGG

*Attesting Officer*

*Commissioner of Patents and Trademarks*